US007455083B2

(12) United States Patent
Schlaf

(10) Patent No.: US 7,455,083 B2
(45) Date of Patent: Nov. 25, 2008

(54) ACCUMULATOR FOR GASEOUS SYSTEMS

(76) Inventor: Gerald Schlaf, 1132 Lakeview, Wolverine Lake, MI (US) 48390

( * ) Notice: Subject to any disclaimer, the term of this patent is extended or adjusted under 35 U.S.C. 154(b) by 394 days.

(21) Appl. No.: 11/221,042

(22) Filed: Sep. 7, 2005

(65) Prior Publication Data

US 2006/0076075 A1 Apr. 13, 2006

Related U.S. Application Data

(60) Provisional application No. 60/607,546, filed on Sep. 7, 2004.

(51) Int. Cl.
*B65B 1/04* (2006.01)

(52) U.S. Cl. ..... 141/93; 137/102; 137/207

(58) Field of Classification Search ..... 141/65, 141/313, 93, 98; 422/173, 177, 115; 110/214, 110/345; 137/12, 102, 207, 209, 210; 55/361, 55/377; 60/281; 454/351, 346, 343; 65/134.6
See application file for complete search history.

(56) References Cited

U.S. PATENT DOCUMENTS

| | | | | |
|---|---|---|---|---|
| 2,469,006 | A * | 5/1949 | Shelby | 417/49 |
| 2,949,126 | A * | 8/1960 | Kuntz et al. | 137/207 |
| 3,167,415 | A | 1/1965 | Edwards | 55/302 |
| 3,838,977 | A | 10/1974 | Warren | 23/288 |
| 4,174,065 | A | 11/1979 | Knauth | 236/49 |
| 4,247,519 | A | 1/1981 | Sano | 422/169 |
| 4,270,694 | A | 6/1981 | Knauth | 236/49 |
| 4,280,826 | A | 7/1981 | Johnson, Jr. | 55/302 |
| 4,454,894 | A | 6/1984 | Tallon | 137/599 |
| 4,538,605 | A * | 9/1985 | Gedeon et al. | 128/205.24 |
| 4,645,520 | A | 2/1987 | Huttlin | 55/302 |
| 4,758,255 | A | 7/1988 | Yamada et al. | 55/316 |
| 4,874,007 | A * | 10/1989 | Taylor | 137/312 |
| 4,883,418 | A | 11/1989 | Hehl | 425/217 |

(Continued)

FOREIGN PATENT DOCUMENTS

DE 003903140 A1 8/1989

(Continued)

*Primary Examiner*—Ninh H Nguyen
*Assistant Examiner*—Jason K Niesz
(74) *Attorney, Agent, or Firm*—Gifford, Krass, Sprinkle, Anderson & Citkowski, P.C.

(57) ABSTRACT

A system for exhausting gas from a source constituting a machine or process which operates on a cyclical basis and generates exhaust gas at a relatively high volume of gas in a short period, at one or more points in its operational cycle. The system includes a first fan or blower which operates continuously and handles a flow volume which is at least equal to the average flow from the source but is lower than the high flow volume produced by the machine or process at intermittent times during its operational cycle. The exhaust from the source in excess of the average is fed into an accumulator at such times as the machine or process is emitting volumes higher than the volume of the constantly operated blower. The constantly operated blower continuously exhausts the accumulator. The energy demands and cost of the exhaust system are therefore substantially lower than a system which would be designed to continuously exhaust the process at the high volume required intermittently. The invention may be used with injection molding machines or the like. The accumulator might comprise an expandable chamber including a dropout for heavy particles or apparatus for processing the exhaust gases before they are passed to the atmosphere or filtering apparatus.

3 Claims, 3 Drawing Sheets

U.S. PATENT DOCUMENTS

| | | | | |
|---|---|---|---|---|
| 5,145,648 | A | 9/1992 | Miyahara et al. | 422/124 |
| 5,240,399 | A | 8/1993 | Baxi et al. | 425/190 |
| 5,823,177 | A | 10/1998 | Whitehead | 126/640 |
| 6,042,791 | A * | 3/2000 | Johnson et al. | 422/173 |
| 6,059,497 | A | 5/2000 | Iannone | 410/87 |
| 6,122,908 | A * | 9/2000 | Wirmark | 60/274 |
| 6,343,591 | B1 | 2/2002 | Hara et al. | 123/519 |
| 2001/0027657 | A1 * | 10/2001 | Yamasaki et al. | 62/222 |

FOREIGN PATENT DOCUMENTS

| | | | |
|---|---|---|---|
| JP | 361046457 | A | 3/1986 |

* cited by examiner

ACCUMULATOR FOR GASEOUS SYSTEMS

RELATED APPLICATION

This application claims priority of U.S. Provisional Patent Application Ser. No. 60/607,546 filed Sep. 7, 2004, which is incorporated herein by reference.

FIELD OF THE INVENTION

This invention relates to exhaust systems for contaminated gases produced by industrial machines or processes and more particularly to an exhaust system which is constantly ventilated by a blower having an output capacity which exceeds the average rate of production of gases by the machine or process and an accumulator for storing gases which are intermittently produced in excess of this average volume and slowly feeding them to the blower.

BACKGROUND OF THE INVENTION

Fan or blower powered exhaust or ventilating systems are often used in industrial plants to remove and sometimes process contaminated gases produced by the machine or process being ventilated. Exhausted gases, sometimes after being processed, may be passed to the atmosphere or, after appropriate filtering and the like, recycled for further use in connection with the machine or process as make-up air. A wide variety of such machines or processes undergo a repetitive operational cycle and emit air or other gases at variable rates at different parts of the cycle. These gases may be generated by the machine or process itself or may constitute ventilating or flushing gases introduced to the machine or process. By way of example, casting machines intermittently feed molten metal into molds and require a high volume of ventilating air during the pour. Injection molding machines often use air-assisted molding which generates a high volume of exhaust air for a brief portion of the operational cycle of the machine.

Typical prior art systems have used exhaust blowers sized to exhaust the maximum volume of gases produced by the machine or process at any time during its cycle and operating on a continuous or semi-continuous basis. This requires relatively expensive and energy inefficient exhaust systems and typically requires larger make-up air units than might otherwise be required. For example, a machine might require continuous exhausting at X cubic feet per minute. Periodically, however, the exhaust volume must be increased to a much higher rate of Y cubic feet per minute, for a short period of time. Previous gas exhaust systems would be sized to continuously handle Y feet per minute. The need obviously exists for an improved system capable of meeting the exhaust needs of the machine without continuously operating at the highest exhaust rate required by the machine or process.

SUMMARY OF THE INVENTION

The present invention is accordingly directed toward an exhaust system for gaseous products of an industrial machine or process which operates on a repetitive cycle and must be exhausted at a higher rate at selected times in the cycle than at other times. This exhaust system is designed to operate continuously at the average volume of exhaust from the machine or process rather than the peak exhaust volume. During the periods of peak gaseous production from the machine or process, the output gas for the system, or at least that part of it which exceeds the average flow volume handled by the exhaust blower, is fed into an accumulator. The gas is then fed from the accumulator into the exhaust blower continuously during the cycle. In this manner the flow volume in excess of the average flow volume is stored in the accumulator and gradually released to the output exhaust blower. The accumulator may include apparatus for removing particulate material from the exhausted gases, for processing the gases to remove contaminants, to filter the gases, etc.

BRIEF DESCRIPTION OF THE DRAWING

Other objects, advantages and applications of the present invention will be made apparent by the following detailed description of a preferred embodiment of the invention. The description makes reference to the accompanying drawings, in which.

DETAILED DESCRIPTION OF THE INVENTION

Figure 1:
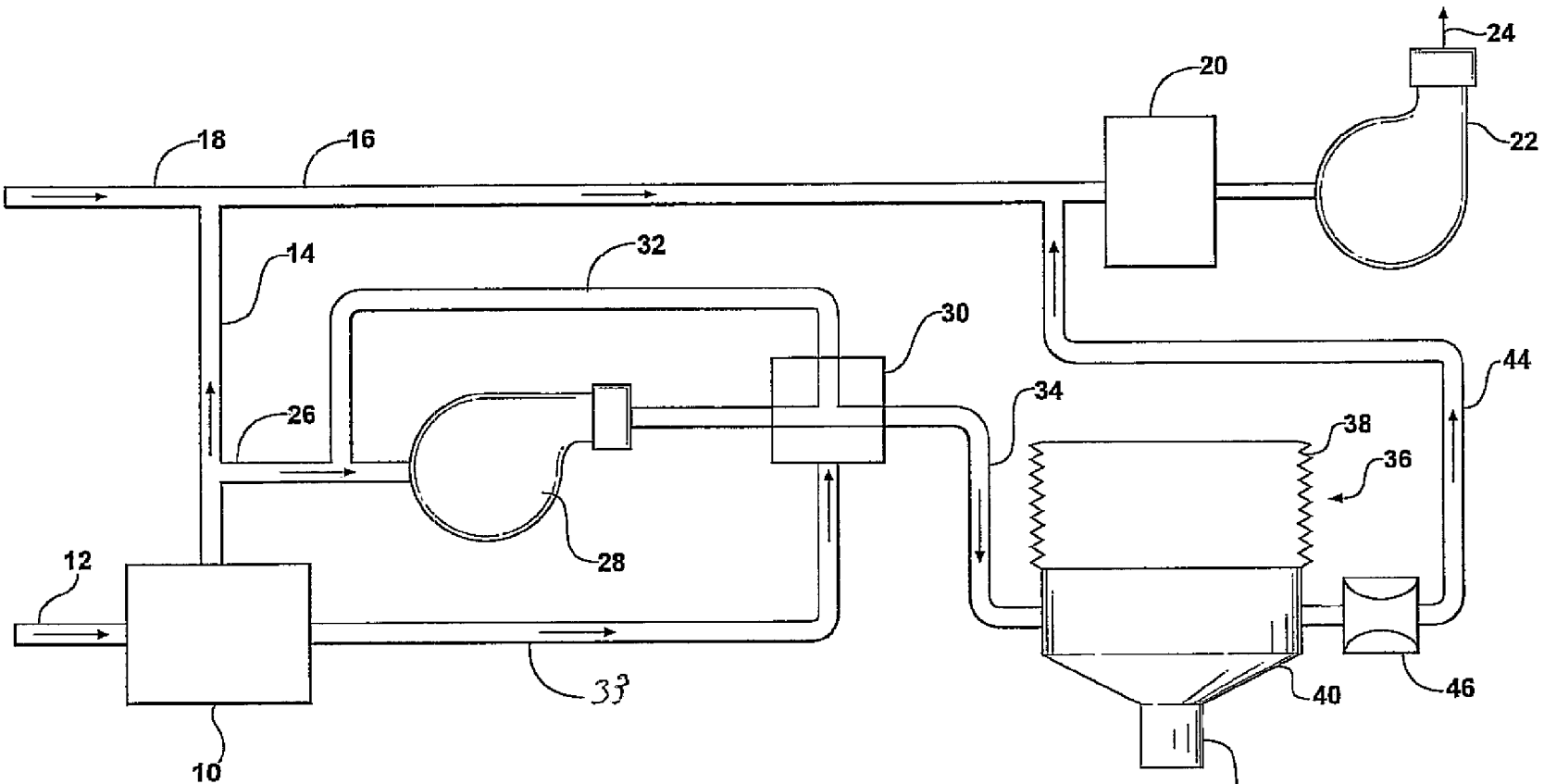
FIG. 1 is a schematic diagram of an exhaust system constituting a first embodiment of my invention.

The process or machine that is serviced by the exhaust system of the present invention is generally indicated at 10 in FIG. 1. It may constitute a machine such as an injection molding machine, a grinder, or any of a wide variety of machines that must be ventilated during operation to remove air or other gases, often contaminated by the machine operation, which must be exhausted to the atmosphere, either before or after processing, by filtration and the like, or so that they may provide return air or gas for operation of further machine cycles. Alternatively, the source 10 may constitute a process which emits gases that must be exhausted during its operational cycle. Chemical reaction processes emit noxious gases which must be removed and exhausted. Similarly, processes such as casting or the like may require a flow of ventilating air or gas at certain points in its operational cycle.

The air or other gas used to ventilate the source 10 may be derived from line 12. The ventilation may be of a push variety, from an external blower (not shown), or the ventilating gases in line 12 may be drawn into the source 10 by the vacuum produced by the exhausting apparatus.

The exhaust from the source 10 may be carried by a duct 14 into a main exhaust duct 16 which also receives air or other gases from other machines or processes, or ambient air from the building housing the exhaust system, from a duct 18. The gases in the duct 16 may be passed through a processing apparatus 20 which could constitute an emissions control, a heat exchanger to change the temperature of the gas, a condensation chamber or other device to alter the state of the gas from the duct 16 before it is exhausted to the atmosphere or returned for further use.

Air or other gas to be exhausted is drawn through the duct 16 and the processing unit 20 by a primary blower 22. The output of the primary blower on line 24 may be exhausted to the atmosphere or returned to the plant for further use as make-up, air or the like either directly, or after passing through other suitable gas processing apparatus.

The blower 22 is designed, in accordance with the present invention, to operate at a flow rate which is at least equal, but preferably somewhat in excess, of the average flow volume required to exhaust the source 14 as well as the air or gas flowing through the duct 18. This average must be computed over a time period which includes all cyclical changes in that air or gas flow, including cyclical operation of the source 10.

In accordance with the present invention, the volume of gas or air outputted from the source 10 will vary during its operational cycle. The present invention does not have applicability to processes in which the exhaust rate from the source 10 as well as the flow of auxiliary air or gases through the duct 18 are constant over a long period of time. In that event the blower 22 is simply designed to be able to handle that average capacity. However, in accordance with the present invention the source 10 will produce exhausts at exhaust rates at one or more times during its operational cycle which are substantially in excess of the average flow from the source 10. Rather than designing the primary exhaust blower 22 with sufficient capacity to continuously handle these peak flow volumes. The blower 22 is designed to handle the lower average flow.

The exhaust from the source 10 also flows to an auxiliary duct 26 which feeds a secondary blower 28 designed to have sufficient capacity to handle the flow volumes from the source 10 which exceed the average volume produced over its cycle by the source 10. The blower 28 provides its output to a two-way directional switching device 30. In one position of the valve 30, employed when the volume of exhaust from the source 10 does not include peaks which exceed its average flow volume, the output of the blower 28 is fed back to the input on line 32 and relatively low energy is required to power the blower 28. At times when the exhaust from the source 10 must exceed its average flow volume, a control line 33 provides a signal to the valve 30, switching it to a position where flow is terminated through the feedback line 32, and is instead directed through duct 34 to an accumulator, generally indicated at 36.

The accumulator 36 constitutes a variable capacity gas storage device which has a flexible enclosure 38 connected to a hopper 40. As the valve 30 is switched to provide the flow output from the blower 28 into the accumulator 36, the flexible enclosure 38 expands to receive and temporarily store the exhausted gases. The bottom of the hopper is preferably sloped to receive any particulate matter that falls out of the exhaust gases which may be periodically removed through an outlet 42.

The accumulator 36 is continuously exhausted through the processing apparatus 20 and the blower 22 via a duct 44, through an adjustable orifice or damper 46 which limits the flow rate through duct 44 to volumes that represent the average of the peak volumes fed into the accumulator over the operational cycle of the source 10. Thus, the volume in the accumulator 40 is reduced at a constant rate.

To better understand operation of the system of FIG. 1, assume that the machine or process constituting the source 10 repetitively undergoes a one-minute cycle in which 55 seconds requires an exhaust rate of 1,000 CFM (cubic feet per minute of air or gas) and 5 seconds requires a blast of 12,000 CFM. Prior art exhaust systems would be designed with blowers 22 which may be sized for 12,000 CFM. With the present system, the blower 22 could be sized for slightly in excess of 1,020 CFM with the blower 28, which only draws power intermittently, sized for 12,000 CFM and the accumulator sized at 1,000 cubic feet capacity. This capacity is sufficiently large to hold the five-second flow at 12,000 CFM. The blower 22 would run constantly at a level slightly in excess of 1,020 CFM so that it could handle the 1,000 CFM flow for 55 seconds of each minute and also exhaust the bag at 20 cubic feet per second. As a result, the bag would be emptied in 50 seconds and be ready for the next five-second blast.

In an alternative embodiment of the invention constituting a variation on FIG. 1, the blower 28 might be eliminated and with forced ventilation from the blower on the line 12, the output on line 26 could be fed directly into an accumulator 36 with an appropriate adjustable orifice connecting line 14 to line 16.

Figure 2:
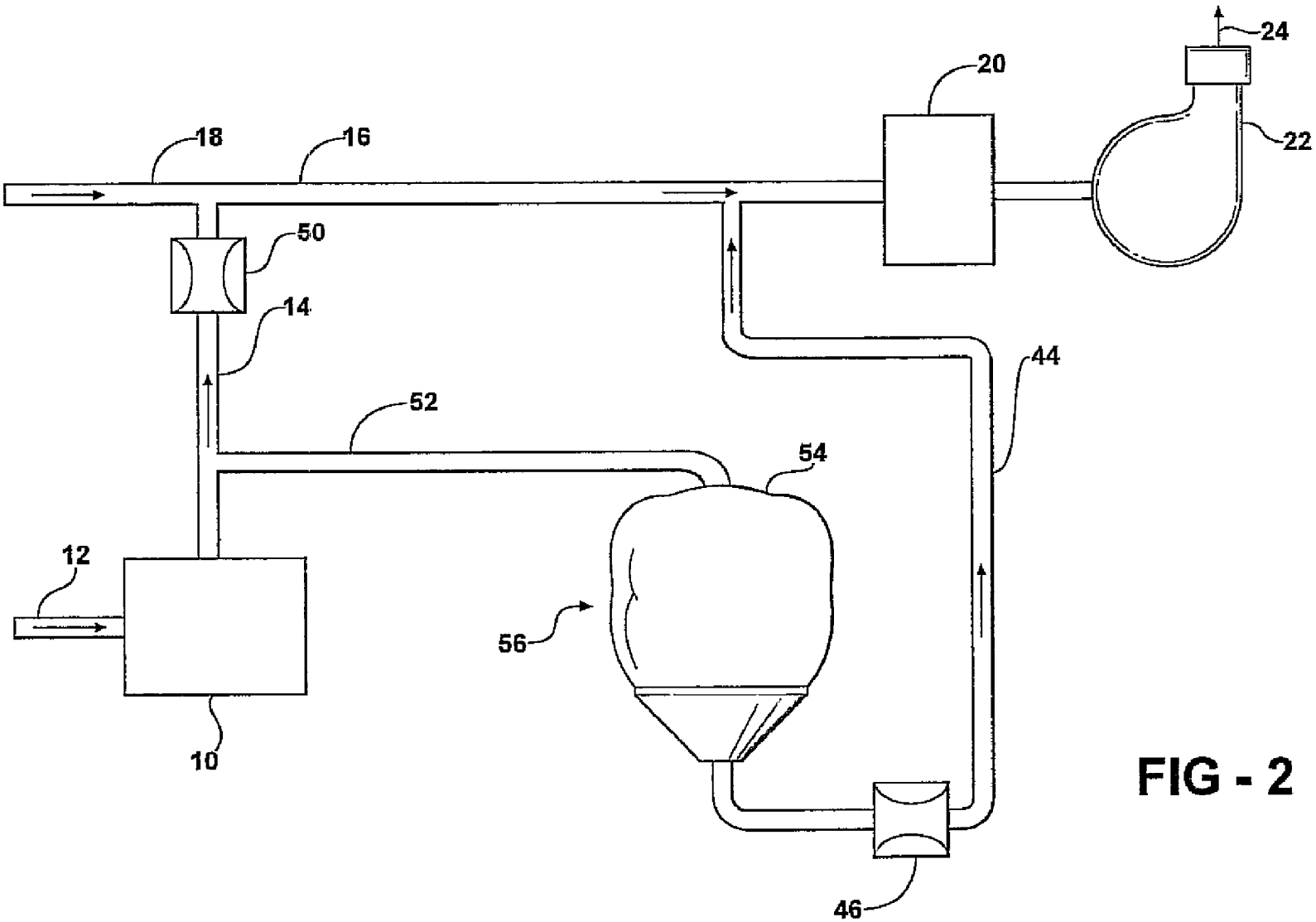
FIG. 2 is a schematic diagram of a second embodiment of my invention.

FIG. 2 represents a modification of the system of FIG. 1 employing similar numerals to indicate the elements of FIG. 2 which are identical to the elements of FIG. 1.

In the system of FIG. 2, a source 10 provided with ventilating air from the line 12 provides a flow volume equal to its nominal flow volume over its cycle, without peaks, to a duct 14 which passes through a flow emitting valve 50 into the duct 16. This flow may be joined by an average flow volume from other plant sources through duct 18 and is then fed out the blower 22 through any necessary processing apparatus 20.

Flow volume peaks in excess of the average from the source 10 are fed through a duct 52 to the top of a variable volume bag 54 forming part of an accumulator generally indicated at 56. The volume within the accumulator is constantly drained during the operational cycle through a flow restricting valve 46 into a duct 44 which feeds the processor 10 and the exhaust blower 22.

Again, like the embodiment of FIG. 1, the blower 22 may be sized to handle the average flow from the source, plus any contribution through the duct 18. Peak values in excess of that average are fed to the accumulator 56 and are constantly drained through the duct 44 to the blower 22. By sizing the blower 22 to handle that average volume through the ducts 16 and 44, it may be sized substantially smaller than prior art blowers required to handle the peaks from the process 10 as well as any flow through the duct 18.

Figure 3:
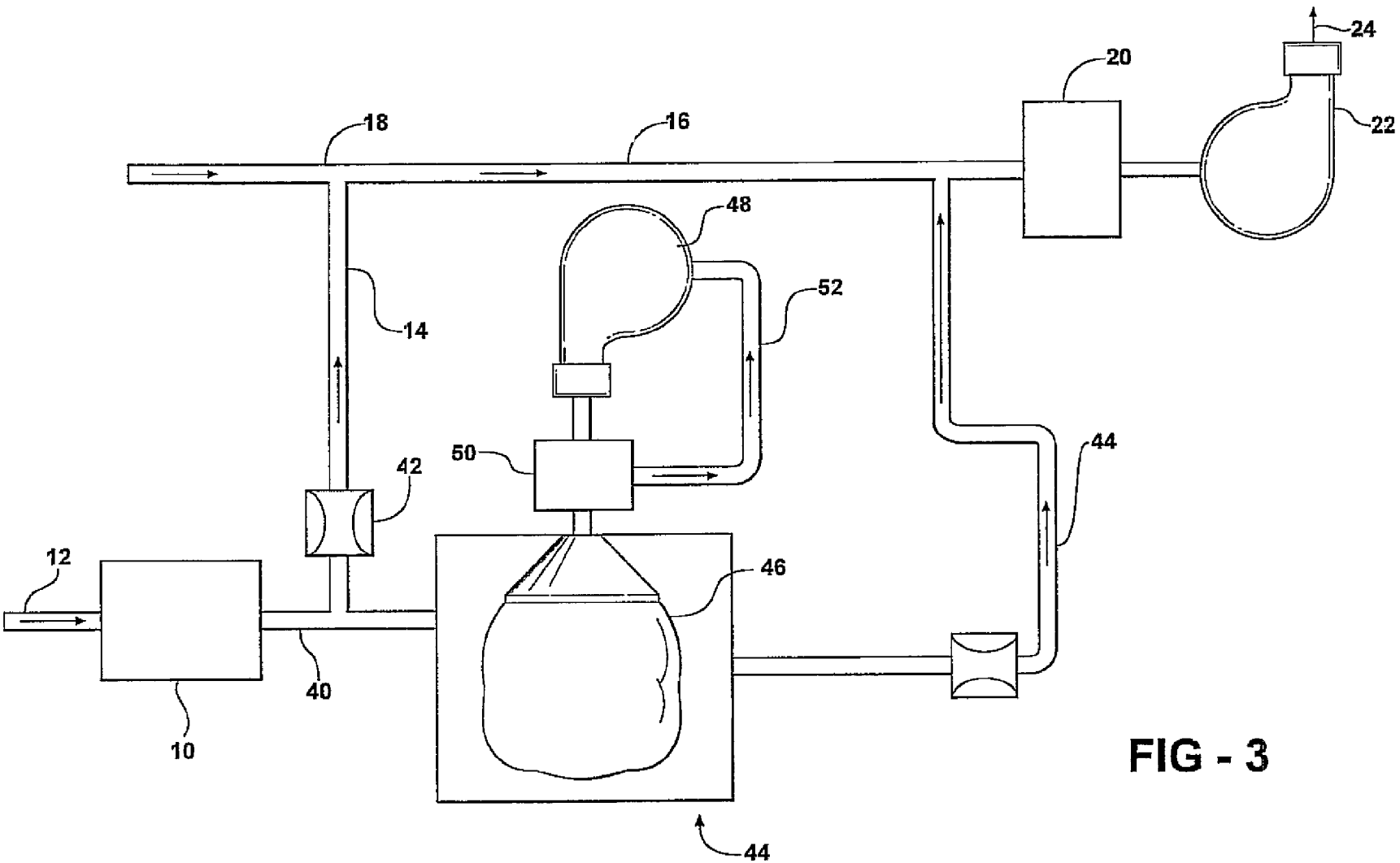
FIG. 3 is a schematic diagram of a third embodiment of my invention.

FIG. 3 illustrates a third embodiment of the invention wherein like numerals are employed to identify structures which are identical to structures described in connection with FIGS. 1 and 2. Again, the source of the exhaust 10, which may be a production machine or process, may be positively ventilated by an air flow through duct 12. The exhaust output of the process, on line 58, is fed to a flow restriction valve 50 which allows a continuous flow through the duct 14 to join the flow from other plant facilities in duct 16. Duct 16 may be passed through preprocessing apparatus 20 including dehydration, filtration and the like and then passed to the exhaust duct 24 which feeds to the atmosphere or to plant make-up equipment and is powered by the blower 22 which operates at about the average exhaust output from the source 10 as well as the additional exhaust on line 18.

The average exhaust value is passed by the restrictor valve 50 to the line 14. Intermittent peak volumes in excess of the average volume are fed to an accumulator booth generally indicated at 60 which might constitute a hood over the source. The booth 60 contains a flexible bag 62 of variable volume. The interior of the bag 62 is maintained at a slight positive pressure, allowing the bag 62 to essentially fill the volume on the interior of the booth 60 in the absence of any flow from the source 10. This low positive pressure is maintained by a low volume blower 64 with a pressure relief valve 66 at its output, feeding back on line 68 to its input.

When the output flow from the line 58 exceeds the flow allowed by the restrictor valve 50, the excess volume is fed to the booth 60, deflating the bag 62 with the gas within the bag escaping through valve 66. After this surge, evacuation of the booth exterior of the bag 62 by the negative pressure from the blower 22, acting through the restrictor valve 46, allows the bag 62 to reinflate with air from the blower 64.

Having thus described my invention,

I claim:

1. An exhaust system for gases generated by a source providing an average flow volume over an operational cycle with intermittent peaks which exceed the average value, comprising:

a primary exhaust fan for gases having a flow volume substantially equal to the average flow volume required from the source, directly connected to the source;

an accumulator for exhaust gases;

an orifice connected in a flow line between the accumulator and the exhaust fan for feeding gases from the accumulator to the exhaust fan at a constant rate over the operational cycle; and a secondary exhaust fan operative to feed exhaust volumes from the source, in excess of said constant volume, to the accumulator.

2. The exhaust system of claim 1 wherein the secondary exhaust fan has a two-way valve at its output, one position of the valve feeding a feedback path to the input of the secondary exhaust fan and the second position of the valve feeding the accumulator.

3. The exhaust system of claim 1 wherein the position of the two-way valve is controlled by the status of the source.

* * * * *